United States Patent [19]

Cerier et al.

[11] Patent Number: 4,807,360

[45] Date of Patent: Feb. 28, 1989

[54] SHAVING DEVICE

[75] Inventors: Jeffrey C. Cerier, Franklin; Robert A. Trotta, Pembroke; Jill M. Shurtleff, South Boston, all of Mass.

[73] Assignee: The Gillette Company, Boston, Mass.

[21] Appl. No.: 92,021

[22] Filed: Sep. 2, 1987

[51] Int. Cl.[4] ..... B26B 21/00

[52] U.S. Cl. ..... 30/49; 30/41; 30/50; 30/346.5

[58] Field of Search ..... 30/32, 34 R, 41, 42, 30/49, 50, 346.5

[56] References Cited

U.S. PATENT DOCUMENTS

| | | | |
|---|---|---|---|
| 2,040,599 | 5/1936 | Davies . | |
| 2,439,909 | 4/1948 | Ruskin . | |
| 2,598,711 | 6/1952 | Musso | 30/49 |
| 2,614,321 | 10/1952 | Ackerman . | |
| 2,632,242 | 3/1953 | Musso | 30/49 X |
| 2,983,041 | 5/1961 | Kesson . | |
| 2,989,804 | 6/1961 | Yellon . | |
| 3,465,436 | 9/1969 | Musso | 30/49 |
| 3,702,026 | 11/1972 | Scholin | 30/246.5 X |
| 4,302,876 | 12/1981 | Emmett | 30/50 X |
| 4,483,068 | 11/1984 | Clifford . | |
| 4,720,917 | 1/1988 | Solow | 30/49 |

FOREIGN PATENT DOCUMENTS

| | | | |
|---|---|---|---|
| 1076528 | 8/1960 | Fed. Rep. of Germany . | |
| 409902 | 5/1934 | United Kingdom | 30/49 |
| 2024082 | 1/1980 | United Kingdom | 30/41 |
| 2083398B | 7/1983 | United Kingdom . | |

*Primary Examiner*—Frank T. Yost
*Assistant Examiner*—Michael D. Folkerts
*Attorney, Agent, or Firm*—Scott R. Foster

[57] ABSTRACT

A plurality of individual thin-walled generally disk-shaped blades are resiliently mounted in an elastomeric pad. The elastomeric pad, with its individually mounted blades, is disposed over a flexible sponge-like member. The shaving device is flexible and maintains maximum skin contact regardless of the contour of the area being shaved by providing that each individual blade is independently movable with respect to the other blades.

15 Claims, 3 Drawing Sheets

SHAVING DEVICE

BACKGROUND OF THE INVENTION

This invention relates to a multi-directional shaver having a plurality of separate individual thin-walled blades.

More particularly, this invention relates to a flexible shaving device in which a plurality of small generally tubular blades are resiliently mounted on a face of an elastomeric member and above a foam insert for providing multidirectional shaving.

Wet or dry shaving devices having a single blade or foil formed with multiple cutting edges are known. Typical of such patents are U.S. Pat. Nos. 4,483,068; 2,983,041; 2,989,804 and 2,614,321. Abrasive pad shavers to remove superfluous hair are also known, such as shown in U.S. Pat No. 2,040,599. Such prior art devices do not address the specific needs of female shaving to provide proper control of the shaving of legs and underarms in a comfortable, efficient manner.

SUMMARY OF THE INVENTION

Briefly stated and according to an aspect of this invention, the problems associated with the prior art shavers, especially those relating to female shavers, have been solved by providing a flexible shaver comprising a plurality of small thin-walled, generally circular blades. The small generally tubular blades are independently movable. In a preferred embodiment, each blade is formed as a thin-walled cylinder with an inwardly facing flange on one end and an outwardly facing flange on the other end. The inwardly facing flange is sharpened to produce a continuous sharpend blade edge. The outwardly facing flange holds the blade in place in an aperture of movement between the blade and the elastomeric member in response to shaving forces. A sponge-like member is disposed under the razor blades. The sponge-like member includes rinse holes aligned with the central aperture of each tubular razor blade. The elastomeric member is preferably generally eliptical in shape and, with the sponge-like member, provides for the resiliently mounting of the tubular blades to accomplish multidirectional efficient shaving.

It is an object of this invention to provide a flexible shaving device having a plurality of thin-walled blade units.

It is another object of this invention to provide a flexible shaving device in which individual blade units are resiliently mounted to provide multidirectional shaving.

It is a still further object of this invention to provide a pad shaver primarily for female shaving.

It is still a further object of this invention to provide a wet shaving system which provides efficient rinsing.

Briefly stated, and according to an aspect of this invention, a flexible multi-directional shaving device is provided which includes a plurality of small thin-walled blade units resiliently mounted on a face of an elastomeric member. The blade units are exposed on top of a foam insert which allows additional water to be utilized while shaving. Rinse holes are provided through the foam insert in alignment with the central aperture of the tubular blades.

BRIEF DESCRIPTION OF THE DRAWINGS

The invention both as to its organization and principles of operation together with further objects and advantages thereof, may better be understood by referring to the following detailed description of embodiments of the invention taken in conjunction with the accompanying drawings in which.

DETAILED DESCRIPTION

Figure 1:
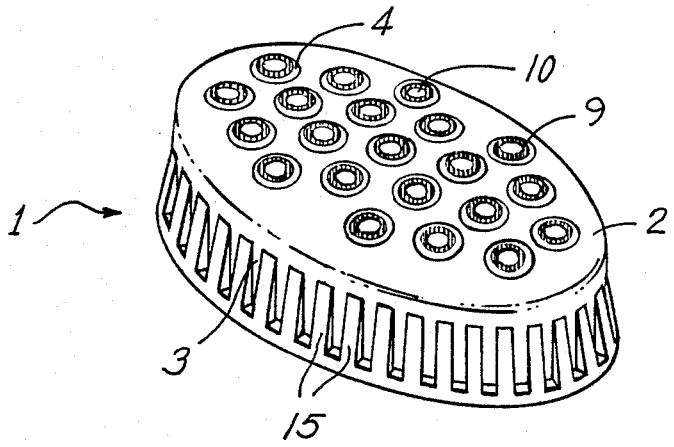
FIG. 1 is a perspective view of an embodiment of a pad shaver, in accordance with this invention.

Referring to FIG. 1, the present invention is directed toward a shaving device or pad shaver 1 having a generally eliptical shape. The major axis of the eliptical pad provides a wide surface for efficient shaving of large areas, such as legs, while the smaller axis provides a narrower surface to facilitate the shaving of concave areas, such as around knees and ankles, and underarms. The narrow ends of the eliptical pad shaver 1 also contribute to good control and access for underarm shaving. While the eliptical shape is preferable with respect to female shaving, the invention is applicable to other shaped shaving devices.

The pad shaver 1 is preferably used with well known shaving preparations such as shaving creams or gels. Pad shaver 1 may also readily be used in the shower or tub. The pad shaver 1 floats, and due to the unique blades, may be safely manipulated by the shaver.

The outer surface or body of the pad shaver 1 is preferably made up of an integrally molded member forming a generally convex top face portion 2 and wall portion 3. Both the top face portion 2 and the wall portion 3 are preferably made of an elastomeric material such as a thermoplastic rubber which can be readily injection molded. The body thus formed is rigid enough to maintain the distances between the centers of the associated blades and flexible enough to allow the blades to retract vertically and angularly with complete independence of one another. The top face portion 2 of the body could be smooth or textured as desired.

Figure 2:
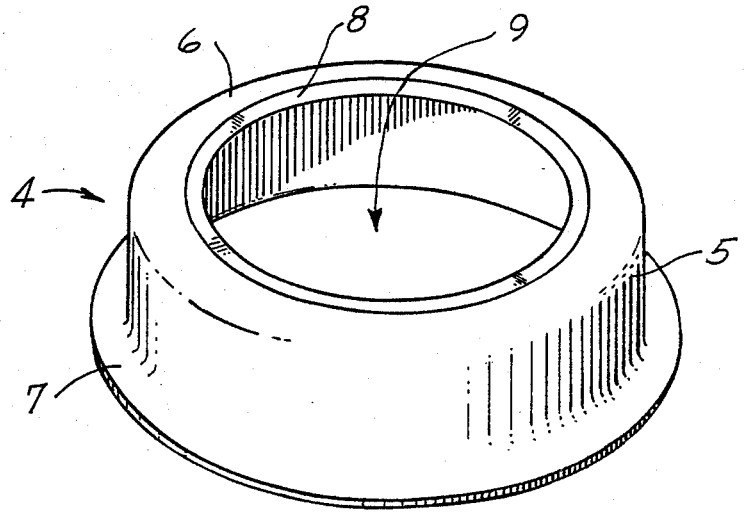
FIG. 2 is a perspective view of a first embodiment of a razor blade, in accordance with this invention.

Disposed through apertures formed in the top face portion 2 of the body of the pad shaver 1 are individual razor blades, such as tubular blade 4. The tubular blade 4, best seen in FIG. 2, has an upstanding, thin-walled continuous cylinder portion or wall 5 with an integral inwardly facing flange 6 on an upper end of the wall 5, and an outwardly facing flange 7 on a lower end of the cylindrical wall 5. The inwardly facing flange 6 is sharpened at its edge to produce a blade edge such as circular blade edge 8. The edge 8 on inwardly facing flange 6 may be formed in a variety of manners well known in the art. The edge 8 may be formed in the same or a different plane than the plane parallel to that of the flange 6 or to the top face portion 2 of the body of the pad shaver 1.

The manufacturing of the blade 4 may be accomplished in a variety of well known manners, such as starting with a flat stock razor blade steel, drawing the steel in a cup-like configuration to have an inwardly facing flange 6 and an outwardly facing flange 7 and then grinding and honing or the like to provide the cutting edge 8. It is also contemplated that the blade 4 could be formed starting with a tubular stock material. The outwardly facing flange 7 is used to hold the blade 4 in place when the blade 4 is positioned through the aperture formed in the top face portion 2 of the body of the pad shaver 1. Each tubular razor blade 4 defines a central through-flow aperture 9.

The specific shape of the tubular blade associated with the practice of this invention may vary. That is, the razor blade need not be cylindrical or disk-shaped. Many other blade shapes are possible as well as the utilization of concentric tandem blade edges in each blade unit. Additional shaving members utilizing the tubular blade concept are disclosed in copending application entitled "Shaving Device" Ser. No. 092,264, filed concurrently herewith and owned by the same assignee as is the instant case, the entire disclosure of which is incorporated herein by reference.

Disposed in the aperture 9 of each blade 4 is a concentrically located guard member 10, which will be described in greater detail when referring to FIG. 4. The guard member 10 is preferably formed as a small molded plastic part which is located concentrically in the pad shaver blade 4. The guard member 10 prevents excessive skin bulge from entering the aperture 9 of blade 4, thus preventing nicks and cuts while allowing hair to be cut.

In the embodiment of FIG. 1, twenty-one blades are illustrated. Each blade 4 is disposed in a respective aperture in the top face portion 2 of the body of the pad shaver 1. The apertures formed in the top face portion 2 of the body of the pad shaver 1 are preferably molded through the top face portion 2 to provide the mounting of the razor blades. The outer diameter of the outwardly facing flange 7 is greater than the diameter of its respective molded aperture formed in the top face portion 2 of the pad shaver 1 to provide a convenient mounting for the razor blade 4. The high number of razor blades 4 provide more usable blade edge than in more conventional razors. Thus, a close shave is quickly achieved. The body of the pad shaver 1 is rigid enough to maintain the distances between the centers of the blades 4 However, it is flexible enough to allow the blades 4 to retract vertically and angularly with complete independence of one another. Thus, in operation, each razor blade 4 is free to move in a downward direction in response to shaving forces with respect to the top surface of the top face portion 2.

Figure 3:
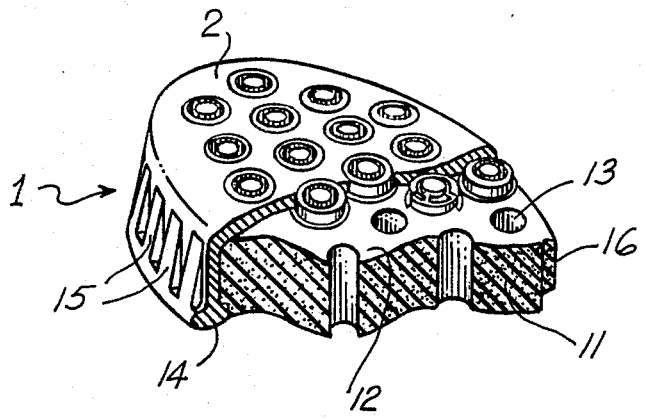
FIG. 3 is a perspective view partial in section, of a pad shaver, in accordance with this invention.

Referring to FIG. 3, disposed inside the body of the pad shaver made up of top face portion 2 and integrally molded wall portion 3 and disposed under the lower end of outwardly facing flange 7 of blade 4, is a flexible sponge-like member 11 The sponge-like member 11 is preferably die cut stamped, or molded out of an open cell foam material such as a flexible polyurethane. An upper surface 12 of the sponge-like member 11 holds the blades 4 in place in the body of the pad shaver 1. In addition, the upper surface 12 of the sponge-like member 11 cooperates with the underside of the outwardly facing flange 7 of each blade 4 to allow each blade 4 to retract slightly when shaving forces are applied in order to maintain safe shaving with higher shaving forces.

Disposed through the sponge-like member 11 are a plurality of rinse holes such as rinse hole 13, which allow hair and other debris to be readily rinsed. Preferably, a rinse hole 13 will be formed under the central aperture 9 of each blade unit 4 and be disposed completely through the sponge-like member 11.

The sponge-like member 11 also provides some rigidity to the shaving pad 1 and thus facilitates the holding of the pad 1 by the person using it. Further, since the shaving pad 1 of the instant invention is primarily designed to be used as the razor in a wet shaving process, the sponge-like member 11 would allow additional water to be utilized while shaving. If the wet sponge-like member 11 is pressed with a finger or fingers, such as on the bottom of the pad shaver 1, or if the sides of the pad 1 are squeezed together, water expelled by the sponge-like member 11 will exit through the central apertures 9 located in the blades 4, thus introducing more water to the area being shaved. When the integrally molded wall portion 3 is squeezed by the shaver the top face portion 2 of the pad shaver 1 is readily deformed into a more convex shape. Such a deformation is helpful in shaving smaller concave areas of the body.

To increase the integrity of the sponge-like member 11 or to provide a more stable base for the blades, a separate backing member (not shown) made of a thin elastomeric material may be placed between the upper surface 12 of the sponge-like member 11 and the bottom of the top face portion 2 of the body of the pad shaver. The backing member would be shaped to conform to the shape of the top face portion 2 and include a plurality of apertures. Each aperture would be axially aligned with a through-flow aperture 9 of each tubular razor blade 4. The apertures of the backing member would also be in axial alignment with each of the rinse holes 13 of the sponge-like member 11.

A retaining ring 14 integrally formed on the lower edge of the wall portion 3 of the body of the pad shaver 1 may be utilized to hold the sponge-like member 11 securely in place as well as to stiffen side portion 16 of the sponge-like member 11. The retaining ring 14 may alternatively be formed of a rigid molded plastic and fit into a mating groove of wall portion 3 of the body of pad shaver 1. The retaining ring 14 not only holds the sponge-like member 11 securely in place, but it also stiffens the bottom portion of the pad 1 to facilitate gripping. If desired, a special gripping surface, such as vertical gripping ridges 15, may readily be integrally formed on the outer surface of wall portion 3 of the body of the pad shaver 1.

It is also within the scope of this invention to form the body of the pad shaver 1 and the sponge-like member 11 as a single-molded part made of open or closed cell foam or as an elastomer. The retaining ring 14 could also be molded as part of the body by insert molding or by increasing the thickness of the side of the body near the bottom of side portion 3.

Figure 4:
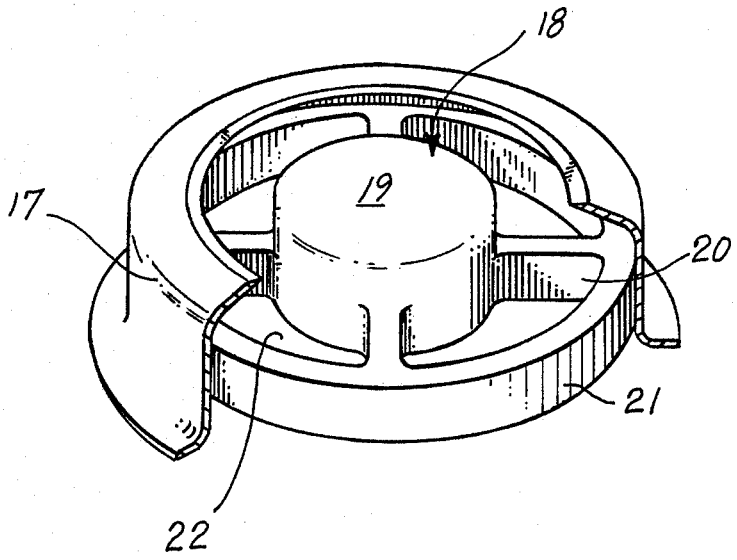
FIG. 4 is a second embodiment of a razor blade, in accordance with this invention.

Referring now to FIG. 4, a razor blade 17 is shown which is similar to blade 4. The blade 17 is shown in section to illustrate a guard member 18. The guard member 18 may be formed as a small molded plastic part trapped, such as press fit, into the central aperture of the blade 17. As an alternative, the guard member 18 could be freely floating within the central aperture of blade 17. That is, the guard member 18 could be designed to move vertically relative to the blade 17.

The guard member 18 includes a central face-engaging portion 19 integrally connected through arms, such as arm 20, to a concentric ring 21. A plurality of rinse slots, such as slot 22, are formed between the face-engaging portion 19, arms 20, and ring 21 to provide good rinsability. The guard member 18 may be also molded entirely, or in part, through a technique such as two-color molding, to include a water-leachable material such as polyethylene oxide, well known in the art.

Figure 5:
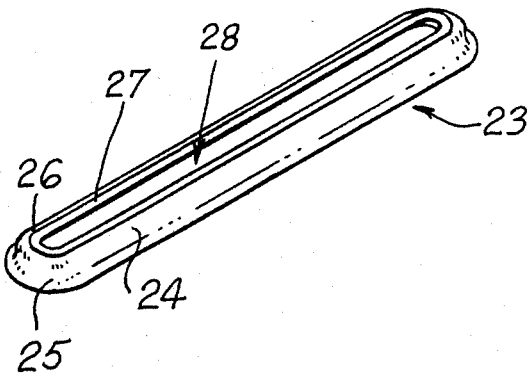
FIG. 5 is a further embodiment of a pad shaver blade, in accordance with this invention.

Referring to FIG. 5, an alternative blade shape is shown in which a tubular blade 23 is more elongated than the generally circular blades previously described. Blade 23 includes an upstanding wall portion 24 as well as an outwardly facing flange 25 and an inwardly facing flange 26, which includes a continuous cutting edge 27 thereby defining a central aperture 28.

Figure 6:
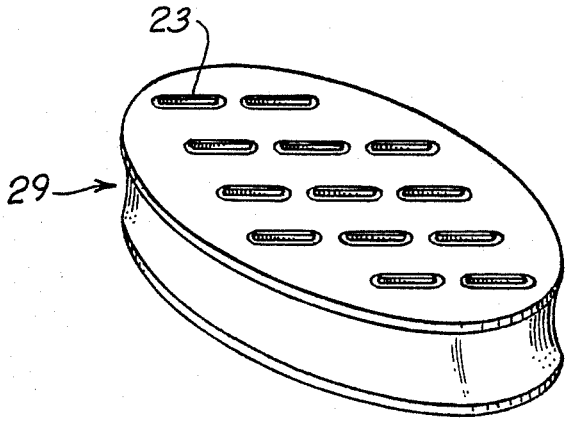
FIG. 6 is a further embodiment of a pad shaver utilizing the razor blade of FIG. 5, in accordance with this invention.

The pad shaver 29 of FIG. 6 illustrates a generally eliptical shaped shaving device having a plurality of blades such as blades 29 of FIG. 5 disposed therein. It is also within the scope of this invention that many other patterns of blade placement on the top face of the pad shaver exist. Several independent blades 4 of different shapes, with or without guards, may also be intermixed.

While embodiments and applications of the invention have been shown and described, it will be apparent to those skilled in the art that many more modifications are possible without departing from the inventive concepts herein described. The invention, therefore, is not to be restricted except as is necessary by the prior art and the spirit of the appended claims.

What is claimed as new and desired to be secured by Letters Patent of the United States is:

1. A multidirectional shaving device comprising:

a plurality of razor blades, each of said razor blades having a generally tubular upstanding wall of a predetermined height and defining a central aperture, said wall having an upper and lower end, an integrally formed inwardly facing flange on said upper end, said inwardly facing flange having a sharpened cutting edge, and an integrally formed outwardly facing flange on said lower end;

a body including an elastomeric member having a face surface and a bottom surface, said elastomeric member including a plurality of apertures, each of said razor blades being disposed in one of said apertures, said bottom surface of said elastomeric member including bearing surfaces disposed over and cooperating with said outwardly facing flanges of said razor blades; and a flexible sponge-like member disposed under said bottom surface of said elastomeric member and under said lower ends of said razor blades, said sponge-like member including a plurality of rinse holes, each of said rinse holes being aligned with said central aperture of one of said razor blades, whereby each of said razor blades is capable of retracting vertically and angularly substantially independently of said other razor blades.

2. The shaving device as in claim 1 wherein said elastomeric member has a predetermined thickness less than the height of said upstanding wall of each of said razor blades.

3. The shaving device as in claim 2 wherein said elastomeric member is flexible and generally elliptical in shape.

4. The shaver device as in claim 3 wherein said sponge-like member includes a side portion and is generally elliptical in shape and wherein said body includes a wall portion integrally molded with said elastomeric member, said wall portion being disposed over said side portion of said sponge-like member for providing a gripping surface.

5. The shaving device as in claim 4 wherein said wall portion of said body includes an integrally formed retaining ring for holding said sponge-like member in place.

6. The shaving device as in claim 4 wherein said elastomeric member is molded of an elastomeric material.

7. The shaving device as in claim 6 wherein said elastomeric material is a thermoplastic rubber.

8. The shaving device as in claim 4 wherein said face surface of said body is generally convex in shape.

9. The shaving device as in claim 8 wherein the squeezing of said wall portion disposed over said side portion of said sponge-like member deforms said face surface of said body to a more convex shape.

10. The shaving device as in claim 4 further including a plurality of guard members, one of said guard members being disposed in said central aperture of each of said razor blades.

11. The shaving device as in claim 10 wherein each of said guard members includes a plurality of rinse slots.

12. The shaving device as in claim 10 wherein each of said guard members includes a water-leachable shaving aid.

13. The shaving device as in claim 12 wherein said water-leachable shaving aid is polyethylene oxide.

14. The shaving device as in claim 1 wherein said upstanding wall of each of said razor blades is formed as a thin-walled cylinder.

15. The shaving device as in claim 1 wherein said upstanding wall of each of said razor blades is formed as a continuous thin-walled elongated member.

* * * * *